United States Patent [19]

Kenyon

[11] Patent Number: 4,856,209

[45] Date of Patent: Aug. 15, 1989

[54] WALKING SHOE WITH PADDED COLLAR

[75] Inventor: Arthur Kenyon, Red Wing, Minn.

[73] Assignee: Red Wing Shoe Company, Inc., Red Wing, Minn.

[21] Appl. No.: 93,880

[22] Filed: Sep. 8, 1987

[51] Int. Cl.[4] ..... A43B 5/00; A43B 7/14

[52] U.S. Cl. ..... 36/114; 36/71

[58] Field of Search ..... 36/114, 89, 92, 93, 36/99, 71, 105; 128/80 H

[56] References Cited

U.S. PATENT DOCUMENTS

| | | | |
|---|---|---|---|
| 2,789,374 | 4/1957 | Planert | 36/71 |
| 3,545,107 | 12/1970 | Cinquegrana et al. | 36/105 |
| 3,768,182 | 10/1973 | Powers | 36/2.5 |
| 4,202,117 | 5/1980 | Bidegain | 36/105 |
| 4,366,634 | 1/1983 | Giese et al. | 36/114 |
| 4,451,996 | 6/1984 | Norton et al. | 36/71 |
| 4,559,722 | 12/1985 | Norton | 36/114 |
| 4,571,856 | 2/1986 | Lin et al. | 36/114 |
| 4,577,419 | 3/1986 | Chassaing | 36/114 |
| 4,644,673 | 2/1987 | Gamm | 36/114 |
| 4,662,088 | 5/1987 | Autry et al. | 36/105 |
| 4,676,011 | 6/1987 | O'Rourke et al. | 36/114 |

FOREIGN PATENT DOCUMENTS

| | | | |
|---|---|---|---|
| 1013288 | 12/1965 | United Kingdom | 36/114 |

*Primary Examiner*—Steven N. Meyers

*Attorney, Agent, or Firm*—Merchant, Gould, Smith, Edell, Welter & Schmidt

[57] ABSTRACT

An improved walking shoe which is constructed of a sole assembly and a shoe upper. The shoe upper has an independently attached padded collar with grommet lacing to provide support and protection principally for the ankle and instep regions of the foot.

4 Claims, 2 Drawing Sheets

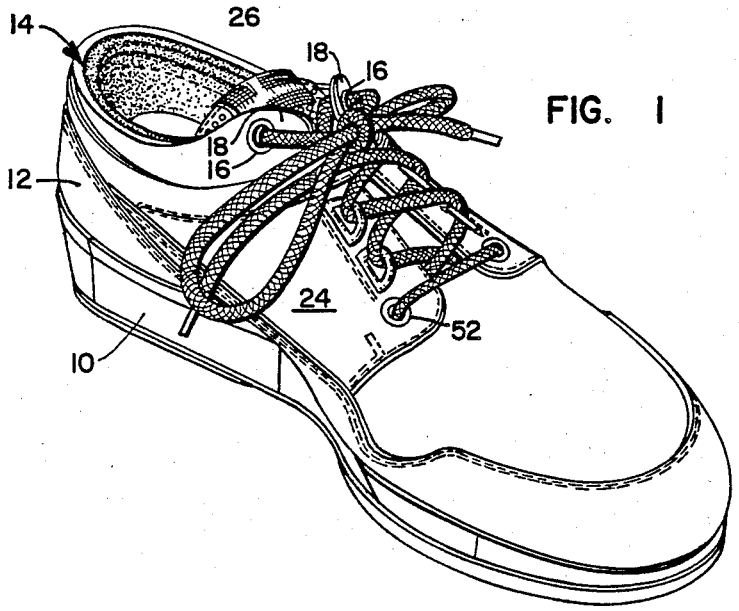
FIG. 1
FIG. 2
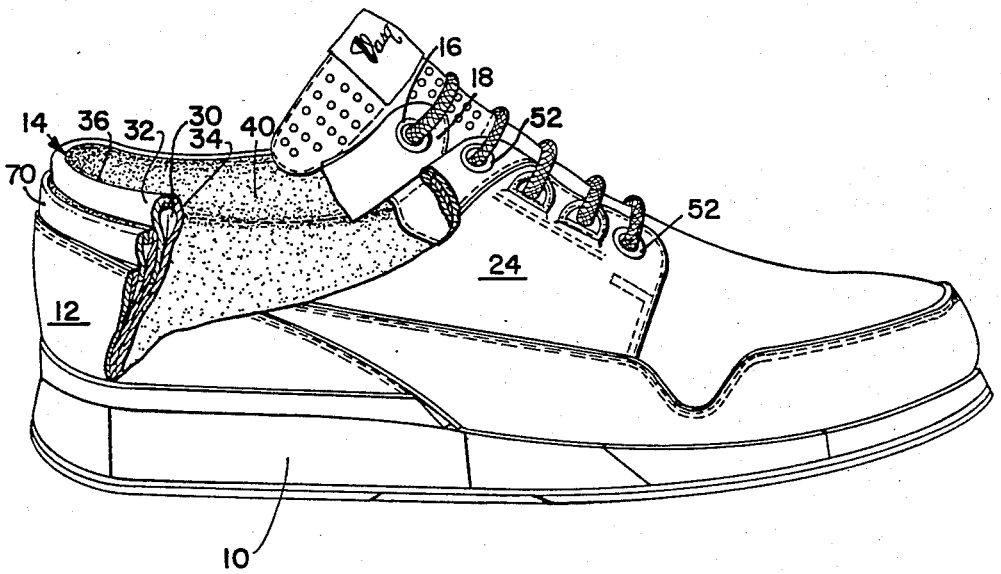

WALKING SHOE WITH PADDED COLLAR

TECHNICAL FIELD OF THE INVENTION

The present invention relates generally to footwear and more specifically to a walking shoe which includes a padded collar with independent lacing.

BACKGROUND OF THE INVENTION

There are many disclosures in the prior art of athletic shoes and boots which include structures for supporting the foot. Typically, such additional support for the foot is not provided in common walking, or normal wear, shoes. Although walking does not normally subject the ankle and foot to the equivalent stresses of athletic movement, the need for enhanced ankle support exists nonetheless.

Normal wear shoes typically do not provide any enhanced ankle support systems within the shoe structure. This results in unnecessary ankle injuries through twisting, shock, and trauma. Similarly, chafing and bruising of the lateral and medial ankle bones result from use of normal wear shoes that are excessively rigid. A further problem exists in normal wear footwear due to a singular lacing system which does not accommodate variable needs for support. Individual wearers of such shoes require different lacing systems and support systems for different parts of their feet. Furthermore, different wearers who have the same shoe length and width size, nevertheless require different instep fit as determined by the tightness of shoe lacings and the ability of the shoe to conform to the shape of the instep and ankle regions. It is also commonplace for debris to enter normal wear shoes through the opening surrounding the ankle area due to flexing of the shoe during walking. To reduce the size of the opening without causing uncomfortable constriction of the foot, particularly the ankle and instep, is therefore a recognized need.

Athletic shoes and boots are well known to include certain support structures for the foot. As illustrated in U.S. Pat. No. 3,768,182 which issued to Al Powers on Oct. 30, 1973, an athletic shoe is designed for wear without stockings, and is therefore made of principally soft material. The rear of the shoe has extra padding designed to protect principally the Achilles tendon. That padding is described as a thick collar along the upper rear portion of said ankle opening except at the extreme rear thereof which is designed to closely surround the Achilles tendon of the foot. The Powers invention does not disclose the collar or manner of attachment of the current shoe, nor does it disclose the lacing technique.

U.S. Pat. No. 4,571,856 issued to Yung-Mao Lin and James C. Autry on Feb. 25, 1986, discloses a hightop-type sneaker which is designed for basketball and similar events. It is designed for providing better support to the ankle area and is comprised of a complete inner and outer structure. Lacing means are provided to adjustably secure both the inner and outer support coverings about the foot and ankle of the wearer. Therefore there is similarity in the lacing technique with the current invention, however, the inner support of the Lin/Autry shoe is attached by stitching or the like to a lateral side of the sole portion of the shoe and extends rearwardly about the ankle of the foot from the point above the heel approximate the Achilles tendon to the medial side of the sole portion and is attached thereto to thus encircle the ankle. The inner support covering extends forwardly over the entire dorsum of the foot to overlay the metatarsal and cuneiform bones. This inner support therefore extends virtually all the way to the forward end of the tongue of the shoe, which is just to the rear of the toe cap. Essentially this Lin/Autry inner support is a complete upper which provides covering for disposal about the ankle of the foot as well as most of the other forward parts of the foot and therefore does not disclose the current invention.

Another Lin/Autry shoe, U.S. Pat. No. 4,662,088 issued May 5, 1987, discloses an above-the-ankle or hightop shoe designed to protect and support the Achilles tendon and ankle. This shoe essentially has an area of extra padding which is located in the back of the shoe near the Achilles tendon. Furthermore, this shoe has only one upper and the lacing therefore only concerns that one upper.

Yet another hightop, single upper athletic shoe is illustrated in U.S. Pat. No. 4,451,996 which issued to Edward J. Norton, et al, on June 5, 1984 and which includes a collar of cushioning material which encloses a cut-out area within the region of each ankle bone and extending around the heel and over the Achilles tendon. The collar of cushioning material actually encloses the cut-out area both above and below the ankle bones. This collar is not a separate part of the shoe but rather an integral part of the upper. The Norton shoe does not have any separate eyelets for lacing the collar.

In U.S. Pat. No. 4,559,722 issued to Edward J. Norton on Dec. 24, 1985, an athletic shoe is disclosed which includes a back tab at the upper heel/ counter portion of the shoe which extends somewhat along the lateral and medial sides of the shoe, and which is designed primarily to support and accommodate the Achilles tendon. The shoe of the invention includes a sole unit and a shoe upper wherein the quarter portions and the upper heel portion are raised to a level very close to the ankle bones to provide increased support along both the lateral and medial sides of the foot. The back tab of the shoe in this patent is made of an inner and outer layer which refers to the inside and outside of the shoe, plus an intermediate layer of a cushioning material. This patent does not disclose the current invention.

Yet another form of foot support structure is found is U.S. Pat. No. 4,577,419 issued to Jacques Chassang on Mar. 25, 1986. The Chaussaing patent discloses an above-the-ankle athletic shoe which has a principal improvement in a tightening strap which essentially wraps around the upper ankle area to prevent ankle injuries.

Common walking, or normal wear shoes, do not provide the enhanced ankle support more often seen in athletic and high-top shoes and boots. Furthermore, even athletic shoes and high-top sneakers or boots do not provide independent lacing and support means for the ankle and upper instep areas.

SUMMARY OF THE INVENTION

This invention relates to a walking shoe type of footwear which has for an object a padded support collar which is attached substantially separate, and at the top of, a shoe upper assembly portion and which provides improved ankle, heel and instep support for the foot.

It is an object of the present invention to provide a collar support to be attached to the upper of a shoe assembly. The padded support collar attachment of the present invention enables the wearer of the shoe to have enhanced ankle support and independent lacing for the upper instep by means of independently attached padded support collar located above and within the shoe upper section.

In accordance with the present invention there is provided a shoe with a sole assembly and upper portion. The upper portion has a padded support collar which protrudes above the top of the upper portion, but which is attached to that upper portion by means of transverse stitching approximately ½ inch below the top of the shoe upper section. The collar encircles the ankle region of the foot from the Achilles tendon around to the top of the instep. Located at the forward end of the collar are two opposing eyelets which serve as either independent or integral closure means. The collar padding is constructed of a teardrop shaped, in the cross-section, foam padding with a rubberized backing.

It is hence the principle object of this invention to provide a shoe of the characteristics described which has a construction that conforms more accurately to individual foot shapes, thereby enhancing the safety, comfort, and overall support provided by this shoe.

Other objects of this invention will in part be obvious and in part hereinafter pointed out.

BRIEF DESCRIPTION OF THE DRAWINGS

While the specification concludes with claims particularly pointing out and distinctly claiming the subject matter as forming the present invention, it is believed that the invention will be better understood from the following description taken in connection with the accompanying drawings in which, FIG. 1 is a perspective view of a laced shoe of the present invention.

FIG. 2 is a cutaway side view showing the construction of the shoe upper and padded support collar sections.

DETAILED DESCRIPTION WITH PREFERRED EMBODIMENTS

Figure 4:
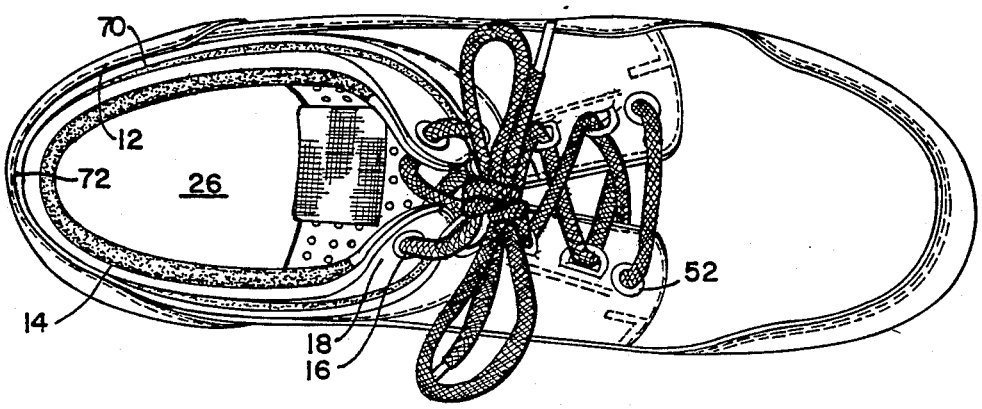
FIG. 4 is a top view of the preferred embodiment of the invention.

Referring to FIG. 1, there is shown a shoe of the present invention which is constructed o a sole assembly 10 and an upper section 12, with the upper section having an independently attached support collar 14. In the preferred embodiment, opposing eyelets 16 are attached to the forward tips 18 of the support collar 14 to provide enhanced fit and support to the heel and ankle regions of the wearer's foot. These opposing eyelets 16 or grommets are suitable for closing the forward tips 18 of the collar 14, by lacing or other means in conjunction with similar closing means for the remaining forward quarter sections of the shoe 24. As shown in FIG. 1, securement of the shoe on the foot may be carried out by lacing.

FIG. 2 illustrates the preferred construction of the support collar 14, which is attached to the interior of the shoe upper section 12 about the ankle opening 26 at approximately ½ inch below the top of the upper section 12. This collar 14 is made of tear drop or wedge-shaped in the vertical inner padding 30 with a wide upper portion and a tapered lower portion, and which is adhesively attached to the inside of the collar outer material 32. In the preferred embodiment, this outer material is formed of a leather strip, but may be constructed from material with similar qualities of strength and softness. The support collar padding material 30 is backed by rubber or similarly constructed material which serves as a support band 34 which extends from the upper rim 36 of the collar downward to connection with the shoe upper section 12. The rubberize support band 34 provides additional strength and rigidity to the padded collar. A cloth liner 40 forms the inner shoe lining immediately adjacent to the wearer's foot, and extends to the top of the rim 36 of the padded collar 14. A separate liner material could also be utilized.

Figure 3:
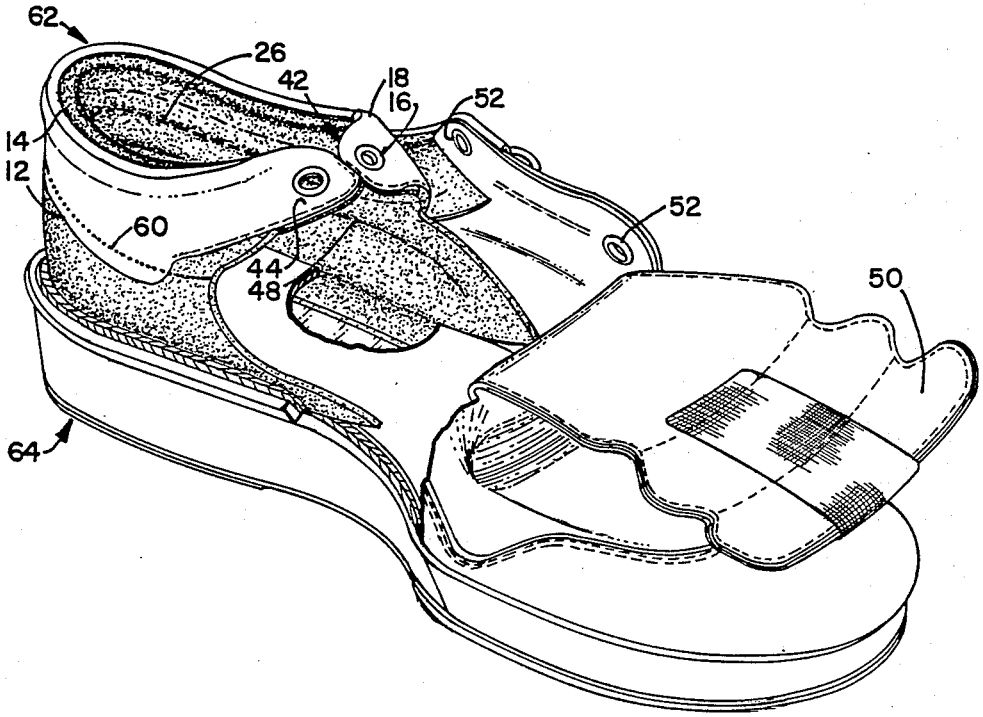
FIG. 3 is a cutaway perspective illustrating the independent attachment and forward collar tips of the present invention.

Referring to FIG. 2 and FIG. 3, the forward portion of the support collar rises at angle G to provide opposing forward collar tips 18. These forward collar tips are constructed of inner 42 and outer 44 reinforced sides which also contain a grommet 16 or other closure support means such as a D-ring or attached loop. In the preferred embodiment, the forward collar tip grommets 16 are of the kind used for lacing and therefore provide an independent means for closing the forward tips of the collar about the instep region 48 of the foot. The forward collar tips 18 are extensions of the padded support collar 14 and are not directly stitched to the shoe upper, therefore enabling said collar tips 18 to conform more closely to various needs of individual wearers. Such variations in shape and size of the region above the intersection of the transverse inferior extensor retinaculum and the longitudinal deep peroneal nerve, or more generally the upper instep region 48, are a common source of discomfort to wearers of shoes which constrict that region. Therefore, the forward collar tip lacing arrangement provides enhanced comfort, protection and prevention from pinching of the upper instep region 48 of the foot.

Thus, the present invention provides footwear wherein support collar 14 is constructed of an elongated intermediate portion and two forward collar tip portions 18. Forward collar tip portions 18 each contain an eyelet 16 of the type for lacing. Preferably, forward collar tip portions 18 are constructed of an inner and outer sheet of leather. Also, forward collar tip portions 18 are free to move approximately one-half inch in the forward and backward directions along the upper instep of the wearer of the shoes. Therefore, the footwear comprises a sole assembly 10 and an upper 12, a support collar 14, and means for attaching the support collar to upper 12 to conform to the shape of a wearer's angle and instep region. Support collar 14 includes two forward collar tips 18 with means for lacing the tips together.

A padded tongue 50 is also located beneath the forward collar tips 18 and the remaining eyelets 52 attached to the forward quarter sections of the shoe upper 24.

The configuration of the support collar 14 along and within the ankle opening 26 formed by the rear upper section 12 of the shoe, in conjunction with the forward collar tip eyelets 16, provide conformal support and protection for the heel, ankle, and upper instep of the wearer. The forces of the support collar function in cooperation with but substantially separate from the support provided by the structural upper 12 section of the shoe and its accompanying closure means 52.

Referring to FIG. 3, a cutaway view of a shoe in the preferred embodiment illustrates the stitched 60 attachment of the support collar 14 to the shoe upper section material 12. The manner of attachment of the padded collar provides a lightweight, economic, and previously undisclosed and non-obvious enhancement to normal wear and activewear shoes. The support collar extends around the foot opening 26 of the shoe to provide support and protection for the region about the Achilles tendon 62, and the inner 64 and outer malleolus 66 regions. Similar support and protection is provided to the upper instep region 48 by the forward collar tips 18. As shown in FIG. 3, the support collar may be independently secured by its own lacing eyelets 16, or said eyelets may be integrally laced with eyelets on the forward quarter sections of the upper shoe 24. Either lacing arrangement provides enhanced support and protection for the heel, ankle and instep regions of the foot.

FIG. 2 and FIG. 4 illustrate the protection afforded the foot by means of the stepped construction of the upper 12 and support collar 14 of the present invention. Such construction provides increased layering protection from shock or trauma to the vulnerable lower foot regions as well as greater closure of the openings immediately around the rim 70 of the upper section 12. Those openings normally allow debris to enter the shoe, but are prevented entry by the conformal protection of the padded support collar 14 of the present invention. The rim 36 of the support collar 14 is above and within the rim 70 of the shoe upper section 12. A further improvement provided by the present invention relates to the reduction in bruising and chafing to the foot of the wearer when inserting said foot into the shoe. Such a bruising or chaffing is commonly caused by stiff shoe uppers. According to this invention, said upper 12 maintains structural rigidity of the shoe while the padded support collar 14 prevents minor foot injuries due to its more supple material. Thus, the support collar 14 also prevents unnecessary, but commonly occurring, structural damage to the vertical heel counter area 72 of shoes resulting from bending and crushing at times of foot insertion into the shoe. The support collar forward tips 18 and lacing eyelets 16 also allow for ease of expansion of the foot opening thereby enhancing said qualities of preventing minor foot injuries and maintaining structural definition at the rear of the shoe. The proper fit and alignment of the heel within the heel counter section 72 of a shoe is critical to the comfort of the wearer. Often, during normal walking movement, the heel counter section 72 of footwear moves up and down the heel and Achilles tendon of the foot causing chaffing or blistering. The padded support collar 14 of the present invention prevents such discomfort by improved fit and more conformal protection to that region of the foot.

The invention accordingly consists in the features of construction, combinations of elements, and arrangement of parts which will be exemplified in the construction described above and of which the scope of the invention will be indicated in the following claims.

I claim:

1. Footwear in the form of a shoe comprising a sole assembly and an upper, said upper having a support collar comprising a strip of padding material which is teardrop shaped in the vertical cross section with a wide upper portion and a tapered lower portion, said padding material being adhesively attached to an outer collar mounting strip which is attached to said upper by stitching, said support collar also including an inner rubberized support band overlaying said padding material, and a cloth liner over said rubberized support band, said cloth liner forming an inner shoe lining immediately adjacent to the wearer's foot, said support collar further having opposing forward collar tips with a pair of opposing eyelets placed in said tips, said forward collar tips being located approximately over the region above the intersection of the inferior extensor retinaculum and the deep peroneal nerve, or more generally the upper instep, said eyelets being adapted to receive a lace for securing said support collar in use, and said forward collar tips being extensions of said support collar beyond that portion of the support collar comprising the outer collar mounting strip which is stitched to the shoe upper, wherein said support collar and eyelets provide support and protection for the heel and the ankle, and the forward collar tips conform more closely to various upper instep shapes in cooperation with but substantially separate from the support and protection provided by said upper in said shoe.

2. Footwear as claimed in claim 1, wherein said padded support collar is attached to said shoe upper, said attachment conforming said support collar to the shape of the wearer's ankle immediately below said wearer's medial and lateral malleolus.

3. Footwear as claimed in claim 1, wherein said padded support collar is constructed of materials which are more supple than said shoe upper.

4. Footwear as claimed in claim 1, wherein said padded support collar is adhesively attached to said shoe upper.

* * * * *